US006926563B2

(12) United States Patent
Morana et al.

(10) Patent No.: US 6,926,563 B2
(45) Date of Patent: Aug. 9, 2005

(54) LOW PROFILE CONTACT ASSEMBLY

(75) Inventors: Francis P. Morana, Mechanicsburg, PA (US); David S. Szczesny, Hershey, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/624,799

(22) Filed: Jul. 22, 2003

(65) Prior Publication Data

US 2005/0020102 A1 Jan. 27, 2005

(51) Int. Cl.[7] ..... H01R 13/00
(52) U.S. Cl. ..... 439/682; 439/74
(58) Field of Search ..... 439/74, 682, 861, 439/342

(56) References Cited

U.S. PATENT DOCUMENTS 4,966,557 A * 10/1990 Barkus et al. ..... 439/246
4,975,069 A * 12/1990 Fedder et al. ..... 439/101
5,224,885 A * 7/1993 Youngfleish ..... 439/861
6,095,842 A 8/2000 Lin ..... 439/342
6,113,411 A 9/2000 Lu et al. ..... 439/342
6,142,810 A 11/2000 Hsiao et al. ..... 439/342
6,454,617 B1 * 9/2002 Chiu ..... 439/857

* cited by examiner

*Primary Examiner*—Phuong Dinh

(57) ABSTRACT

A low profile contact includes a resilient spring portion having a first end and a second end, and a first contact beam and a second contact beam extending from the respective first and second ends of the spring portion. The first contact beam and the second contact beam have substantially parallel distal end portions, and at least one of the distal end portions includes an upstanding guide surface configured to receive and align a connection pin between the distal end portions. The guide surface extends from an upper edge of the contact beam and has a flared tip to receive a pin therebetween as the pin is inserted along an insertion axis perpendicular to a longitudinal axis of the first and second distal end portions.

19 Claims, 6 Drawing Sheets

LOW PROFILE CONTACT ASSEMBLY

BACKGROUND OF THE INVENTION

The invention relates generally to contact assemblies for electrical connectors, and, more particularly to low profile contact assemblies for mezzanine connectors.

The number of input/output ("I/O") pin connections between peripheral circuit boards, sometimes referred to as circuit cards, and main circuit boards, sometimes referred to as "motherboards" in some modern electronic devices is steadily expanding. The motherboard, however, is only capable of accommodating a limited number of I/O connections, and as the number of connections increases, the required I/O connections may exceed the maximum available connection capability of the motherboard. One solution to this problem is the use of a supplemental card portion (i.e., a so-called "mezzanine" card or "daughter" card) that is mounted to the main circuit card in order to provide one or more additional connectors and additional I/O pins. Such mezzanine cards are also used whenever multiple circuit cards are advantageously interconnected for connection to a motherboard.

Typically, the mezzanine connectors include a housing having a number of resilient contacts therein, and the contacts include longitudinal contact beams extending generally perpendicular to the mother board when connected thereto. The connector housing includes alignment features that accept connection pins of a mating connector and guide the pins into secure electrical contact between the contact beams. As the number of connection pins increases, an amount of force required to properly establish the pin connections increases. Consequently, proper alignment of the connection pins with respect to the contact beams is significant. Any misalignment may damage the pins and or the contacts of the mezzanine connector as they are forced together.

As electronic devices become increasingly more compact in size, the use of such mezzanine cards and associated connectors can be problematic. For example, in at least one device, the mezzanine card connector is specified to extend a distance of only about 2 mm above the surface of the mezzanine card for proper interfacing with a motherboard. Known contacts in known mezzanine connectors are not suitable in such devices, both in terms of size and the manner in which the connections are made.

BRIEF DESCRIPTION OF THE INVENTION

According to an exemplary embodiment of the invention, a low profile contact is provided. The contact comprises a resilient spring portion having a first end and a second end, and a first contact beam and a second contact beam extending from the respective first and second ends of the spring portion. The first contact beam and the second contact beam have substantially parallel distal end portions, and at least one of the distal end portions comprises an upstanding guide surface configured to receive and align a connection pin between the distal end portions.

Optionally, each of the distal end portions comprise guide surfaces, and the guide surfaces are divergently flared relative to one another. The guide surfaces of the contact beams extend from an upper edge of the contact beams and have a flared tip. The distal end portions are adapted to receive a pin therebetween as the pin is inserted along an insertion axis perpendicular to a longitudinal axis of the first and second distal end portions. The contact has a profile dimension measured along the insertion axis, the profile dimension being less than about 2 mm between the tip and a lower edge of the contact beams.

In another embodiment, a low profile contact assembly is provided. The assembly comprises a first contact comprising a curved resilient spring portion having a first end and a second end, and a first contact beam and a second contact beam extending from the respective first and second ends of the spring portion. A second contact is provided having a curved resilient spring portion having a first end and a second end, and a first contact beam and a second contact beam extending from the respective first and second ends of the spring portion. The first and second contacts are arranged inversely to one another such that the spring portions of each of the first and second contacts are oriented toward one another in a nested configuration.

In another embodiment, a low profile electrical connector is provided. The connector includes a housing, and at least one low profile contact situated within the housing. The contact comprises a curved resilient spring portion, and a first contact beam and a second contact beam extending from opposite ends of the spring portion. The first contact beam and the second contact beam extend along a longitudinal axis, and at least one of the distal end portions comprises an upstanding guide surface configured to receive and align a connection pin inserted between the fist and second contact beams along an insertion axis substantially perpendicular to the longitudinal axis.

DETAILED DESCRIPTION OF THE INVENTION

Figure 1:
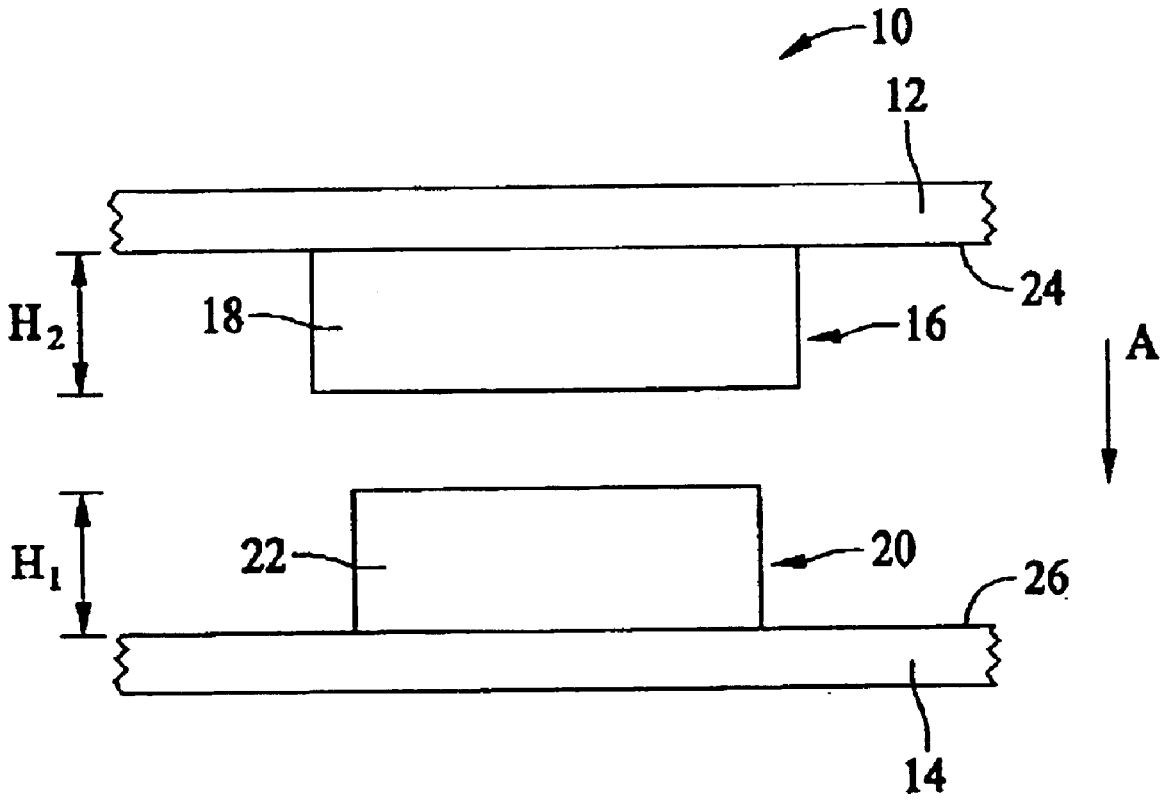
FIG. 1 is a side elevational view of an exemplary mezzanine connector assembly formed in accordance with an embodiment of the invention.

FIG. 1 illustrates an exemplary low profile electrical connector assembly 10 including a motherboard 12 and a mezzanine card or daughter card 14. The motherboard 12 includes a male connector 16 mounted thereto which includes a housing 18 and a number of terminal pins (not shown in FIG. 1) therein. The daughter card 14 includes a female connector 20 having a housing 22 and a number of contacts (not shown in FIG. 1) therein which establish electrical connection between the male and female connectors 16 and 20, which, in turn, establish electrical connection between the motherboard 12 and the daughter card 14. The connector assembly 10 is sometimes referred to as a mezzanine connector assembly and the male and female connectors 16 and 20 are sometimes referred to as a mezzanine connector. It is appreciated, however, that the benefits of the invention accrue to other types of electrical connectors in lieu of mezzanine connectors.

In an illustrative embodiment, the female connector 20 has a compact low profile and extends for a height $H_1$ of only about 2 mm measured substantially perpendicular from the surface 26 of the daughter card 14. That is, the highest portions of the connector 22 extend above the daughter card 14 at a distance of about 2 mm. Likewise, the male connector 16 extends for a distance $H_2$ from the surface 24 of the motherboard 12 for an equal distance of about 2 mm. When the male connector 16 is received over the female connector 20 in the direction of arrow A and the pins in the male connector 16 are fully engaged to the contacts in the female connector 20, the board-to board separation of the motherboard 12 and the daughter card 14 is approximately equal to the distances $H_1$ and $H_2$, or about 2 mm. It is understood that other values for $H_1$ and $H_2$ may be employed in alternative embodiments of the invention to vary the profile of the connector assembly 10.

In an exemplary embodiment, and as explained below, to minimize the profile of the connector assembly 10 the male and female connectors 16 and 20 are surface mounted to respective surfaces 24 and 26 of the motherboard 12 and the daughter card 14. While surface mount technology, such as ball grid array (BGA) technology, is particularly suitable for the low profile connector assembly 10, it is recognized that other types of surface mounting schemes may likewise be employed in alternative embodiments of the invention. It is further recognized that non-surface mount technology (i.e., through-hole mounting) may be employed as size permits of the assembly 10.

Figure 2:
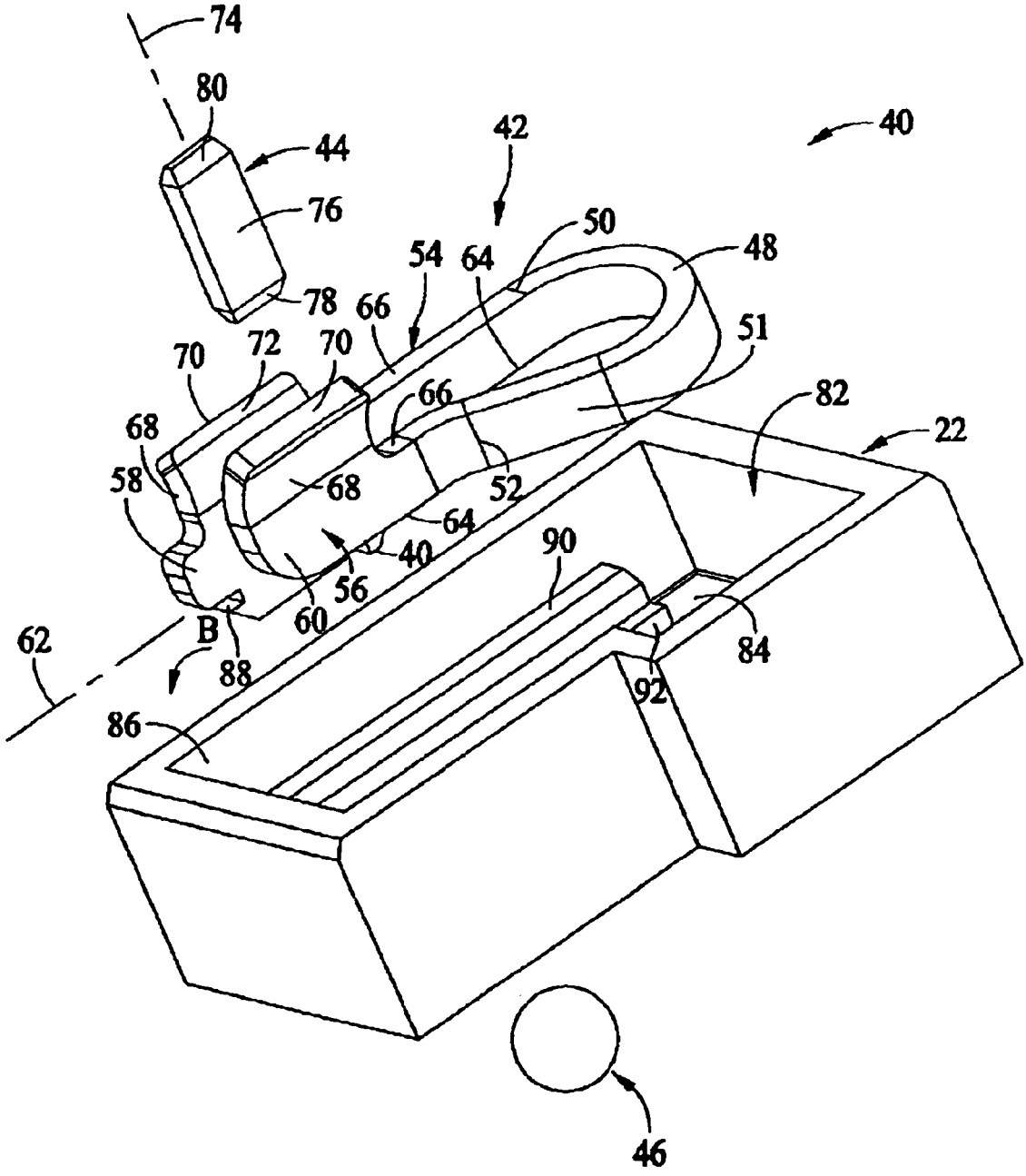
FIG. 2 is an exploded view of a contact assembly for the mezzanine connector assembly shown in FIG. 1.

FIG. 2 is an exploded perspective view of a contact assembly 40 for the mezzanine connector assembly 10 (shown in FIG. 1). The contact assembly 10 includes a female contact 42, a male pin contact 44, and a solder ball 46.

The female contact 42 includes a rounded spring portion 48 having a first end 50 and a second end 52. In an illustrative embodiment, the spring portion 48 is curved from the first end 50 though an approximately 225° arc to an angled portion 51 extending toward the second end 52, thereby somewhat reminiscent of the upper portion of a question mark in shape. A primary contact beam 54 and a secondary contact beam 56 extend from the respective ends 50 and 52 of the spring portion 48. Each contact beam 54 and 56 includes a respective distal end 58 and 60 which extend substantially parallel to one another along a longitudinal axis 62 in a spaced apart relationship to one another.

Each of the contact beams 54 and 56 include a lower edge 64 and an upper edge 66, and the distal ends 58 and 60 each include an upstanding guide member 68 projecting from the upper edge 66. The guide members 68 extend upwardly and outwardly from the upper edge 66 in a divergently flared arrangement relative to one another. That is, the guide members 68 include outwardly flared tips 70 which are spread apart from one another, and the guide members 68 are inwardly inclined or curved toward the longitudinal axis 62 and the respective distal ends 58 and 60 of the contact beams 54 and 56. The guide members 68 thereby form an angled contact surface 72 on opposing interior faces thereof which receive and align the male contact 44 as the male contact 44 is inserted along an insertion axis 74. The insertion axis 74 is substantially perpendicular to the longitudinal axis 62 of the female contact 42, thereby providing a low profile contact arrangement.

To achieve a low profile, in one embodiment the female contact 42 is dimensioned such that a distance from the lower edge 64 of the contact beams 54 and 56 to the tips 70 of the guide members 68 is less than about 2 mm measured along the insertion axis 74. It is appreciated, however, that various dimensions of the female contact 42 may be employed in corresponding alternative embodiments of the invention. In an exemplary embodiment, the female contacts are fabricated from phosbronze according to a stamping and forming operation, although it is contemplated that a variety of suitable materials and fabrication methods may be employed in various alternative embodiments.

In an exemplary embodiment the male pin contact 44 includes a generally rectangular body 76 and opposite beveled ends 78 and 80. The male pin contact 44 is part of a male connector, such as connector 16 shown in FIG. 1. One end 80 of the male pin contact 44 is coupled to the motherboard 12 via a solder ball (not shown in FIG. 2), while the other end 78 is received between the distal ends 58 and 60 of the contact beams 54 and 56. When the male pin contact 44 is engaged to the female contact 42 along the insertion axis 74, the male pin contact 44 separates the distal ends 58 and 60 of the contact beams against a bias of the spring portion 48. That is, the secondary contact beam 56 is deflected by the male pin contact 44 in a direction of arrow B such that the secondary contact beam 56 is deflected at the distal end 60 and is angled with respect to the longitudinal axis 62 of the female contact 42. Deflection of the secondary contact beam 56 gathers the spring portion 48 of the female contact 42 and provides a biasing normal force against the male pin contact 44 to maintain engagement of the male pin contact 44 between the distal ends 58 and 60 of the contact beams 54 and 56.

In the event of any relative misalignment of the male pin contact 44 with respect to the female contact 42, the guide surfaces 72 of the guide members 68 contact the male pin contact 44 and guide the pin contact 44 into proper alignment with the female contact 42. The guide surfaces 72 funnel the pin contact 44 to a position between the contact beams 54 and 56. Reliable and secure electrical connections may be established between the male and female contacts 44 and 42 despite some misalignment of the contacts as they are mated.

It is understood that while one exemplary male pin contact 44 has been described, other shapes and configurations of male contacts may likewise be employed in alternative embodiments of the invention.

The female contact 42 is situated within the housing 22 in a contact cavity 82 having a head portion 84 and a body portion 86 forming an L-shaped envelope. The cavity 82 extends along the longitudinal axis 62 of the female contact 42, and the head portion 84 has an increased width to accommodate the curved spring portion 48 of the female contact 42. The contact beams 54 and 56 extend in the body portion 86, and ribs 90 and 92 are provided in the contact cavity 82.

The primary contact beam 54 of the female contact 42 includes a retainer slot 88 which engages an end of a complementary slot (not shown in FIG. 1) in the housing 22 to locate the female contact 42 with respect to the housing 22. The primary contact beam 54 is fitted between the ribs 90 and 92 such that relative motion of the primary contact beam 54 and the housing 22 is prevented, while the secondary contact beam 56 is free to deflect as the male pin contact 44 is engaged to the distal ends 58 and 60 of the contact beams 54 and 56.

In an exemplary embodiment the primary contact beam 54 further includes a projection 94 extending from the lower edge 64 thereof. The projection 94 extends through the housing 22 to communicate with a solder ball 46 which is rested in a cutout portion of the housing 46, described below. The projection is beveled and somewhat pointed to establish a secure solder connection via solder ball 46.

Figure 3:
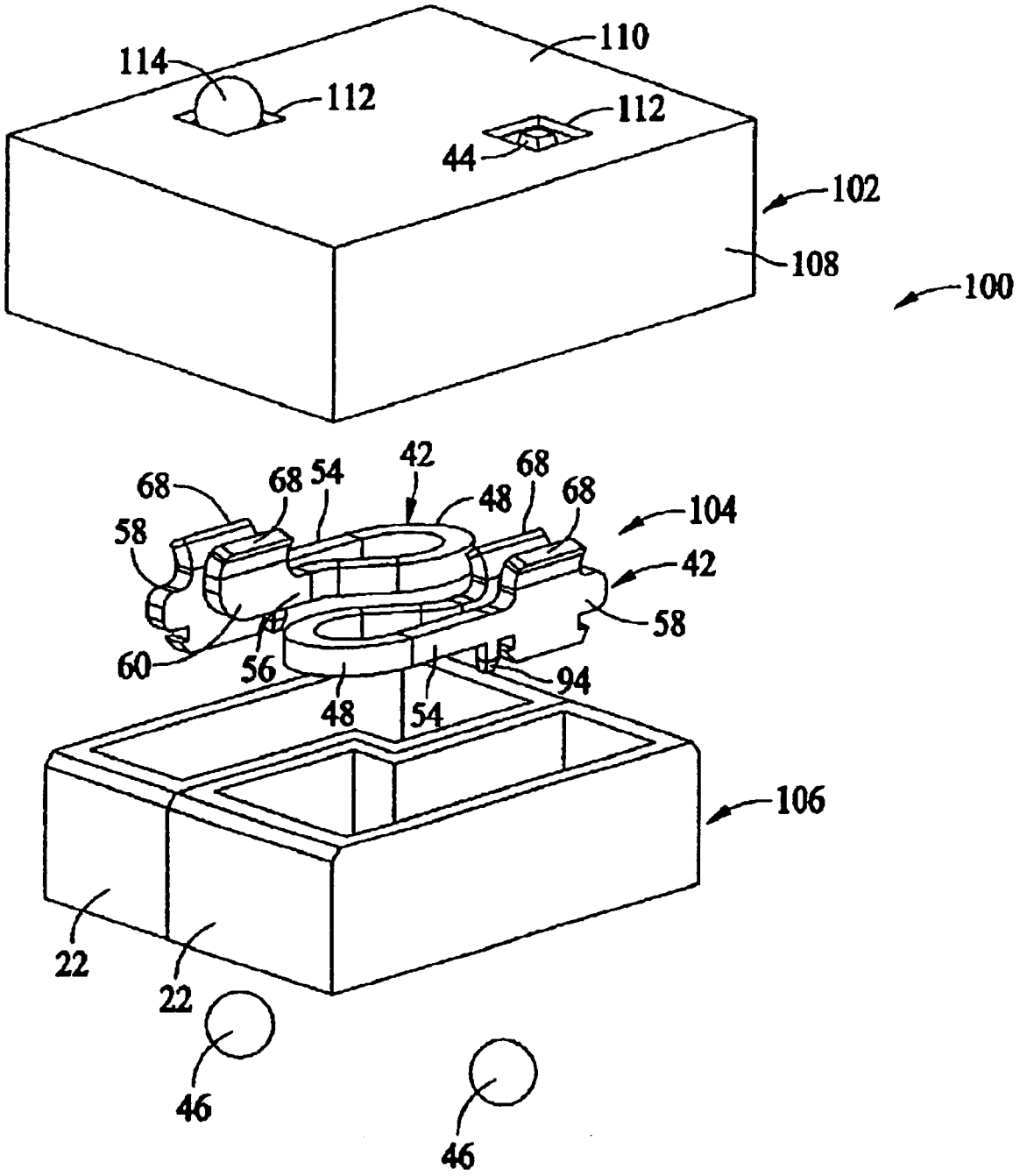
FIG. 3 is a partial exploded view of another embodiment of a mezzanine connector in accordance with the present invention.

FIG. 3 is a partial exploded view of an embodiment of a mezzanine connector assembly 100 formed in accordance with the present invention, and in which like features of the assembly 40 are indicated with like reference characters.

Connector 100 includes a male connector 102, a female contact assembly 104 and a contact assembly housing 106. The male connector 102 includes a substantially rectangular housing 108 having a board mounting surface 110. The mounting surface 110 includes a pair of substantially rectangular cutouts 112, and a beveled end of a male pin contact 44 (only one of which is shown in FIG. 3) extends through each of the cutouts 112. A solder ball 114 (only one of which is shown in FIG. 3) is positioned in each of the cutouts 112 in contact with the respective male pin contact 112, and when the solder balls 114 are reflowed according to a known process, an electrical connection is established between the male pin contacts 44 and a motherboard, such as motherboard 12 shown in FIG. 1.

The female contact assembly 104 includes a pair of contacts 42 as described in detail above. The distal ends 58 and 60 of the contact beams 54 and 56 of the respective contacts 42 are substantially aligned with the male pin contacts 44 in the male connector 102, and the guide members 68 face the male contact pins 44.

The female contacts 42 are arranged inversely to one another to minimize and amount of space occupied by the contacts 42. That is, the respective spring portions 48 of each of the first and second contacts 42 are oriented toward one another in a nested configuration wherein the spring portions 48 of each of the contacts 42 face a contact beam 56 of the adjacent contact. In other words, the spring members 42 are located opposite one another in a head-to-toe configuration with the curved spring portions 48 oriented inward toward the opposing contact 42. With this nesting of contacts 42, contact density on a mezzanine card can be substantially optimized.

The pair of contacts 42 are located within the housing 106, which is essentially a nested configuration of the L-shaped housings 22 described above. That is, the L-shaped housings are inversely oriented relative to one another with the legs of the L-shaped housing forming an interlocking housing 106. The oppositely facing housings 22 may be integrally formed into a singe housing 106 or separately fabricated and attached to form the housing 106.

Solder balls 46 are located in cutout portions of each of the housings 22 for establishing electrical contact with the projections 94 of the contact beams 54.

Figure 4:
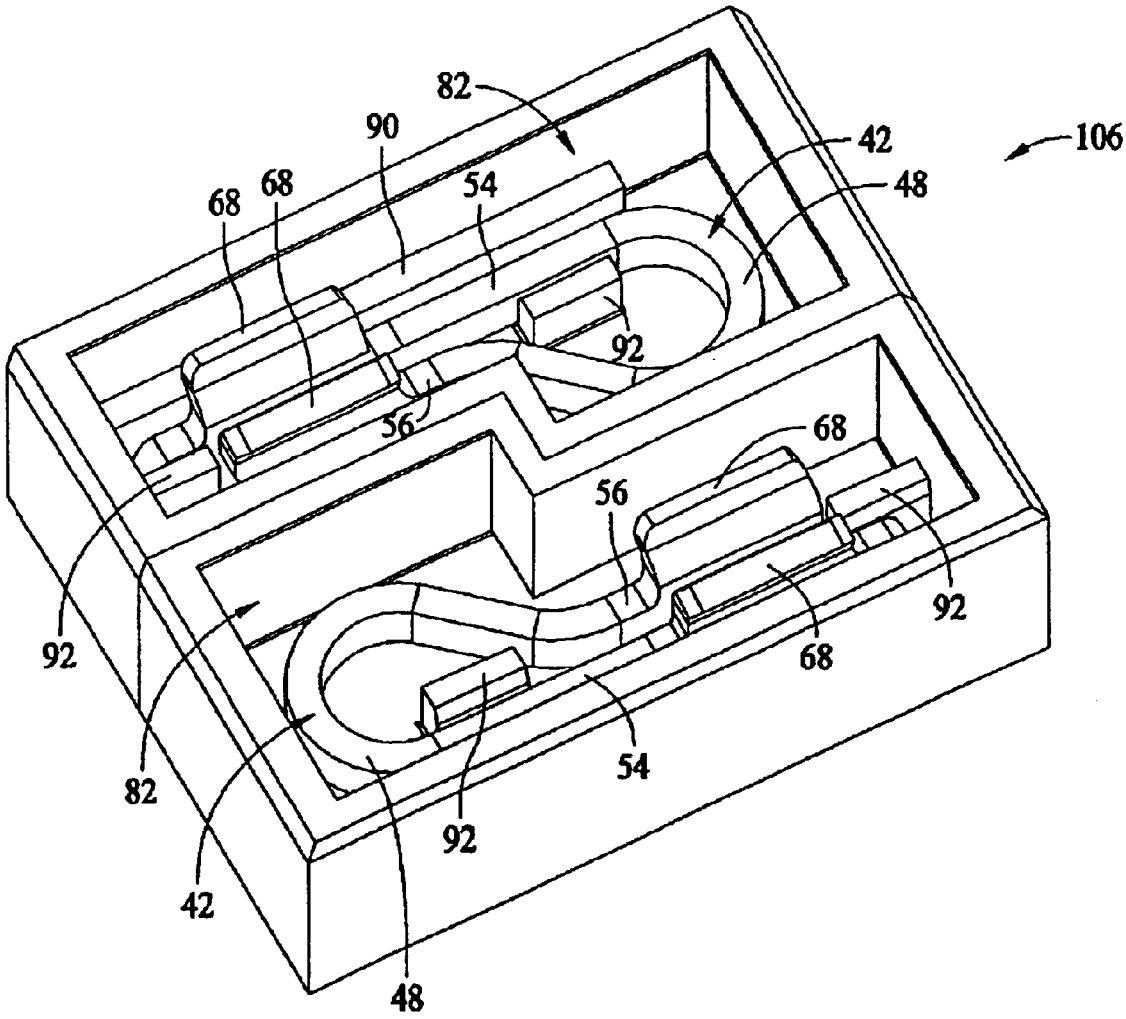
FIG. 4 is a top perspective view of a contact assembly for the mezzanine connector shown in FIG. 3.

FIG. 4 is a top perspective view of the contacts 42 situated in the housing 106. Ribs 90 and 92 are provided in contact cavities 82 of the housing 106. The ribs 90 and 92 constrain the contact beams 54 from relative movement within the contact cavities 82, while the contact beams 56 and the spring portions 48 may deflect within the cavities 82.

Figure 5:
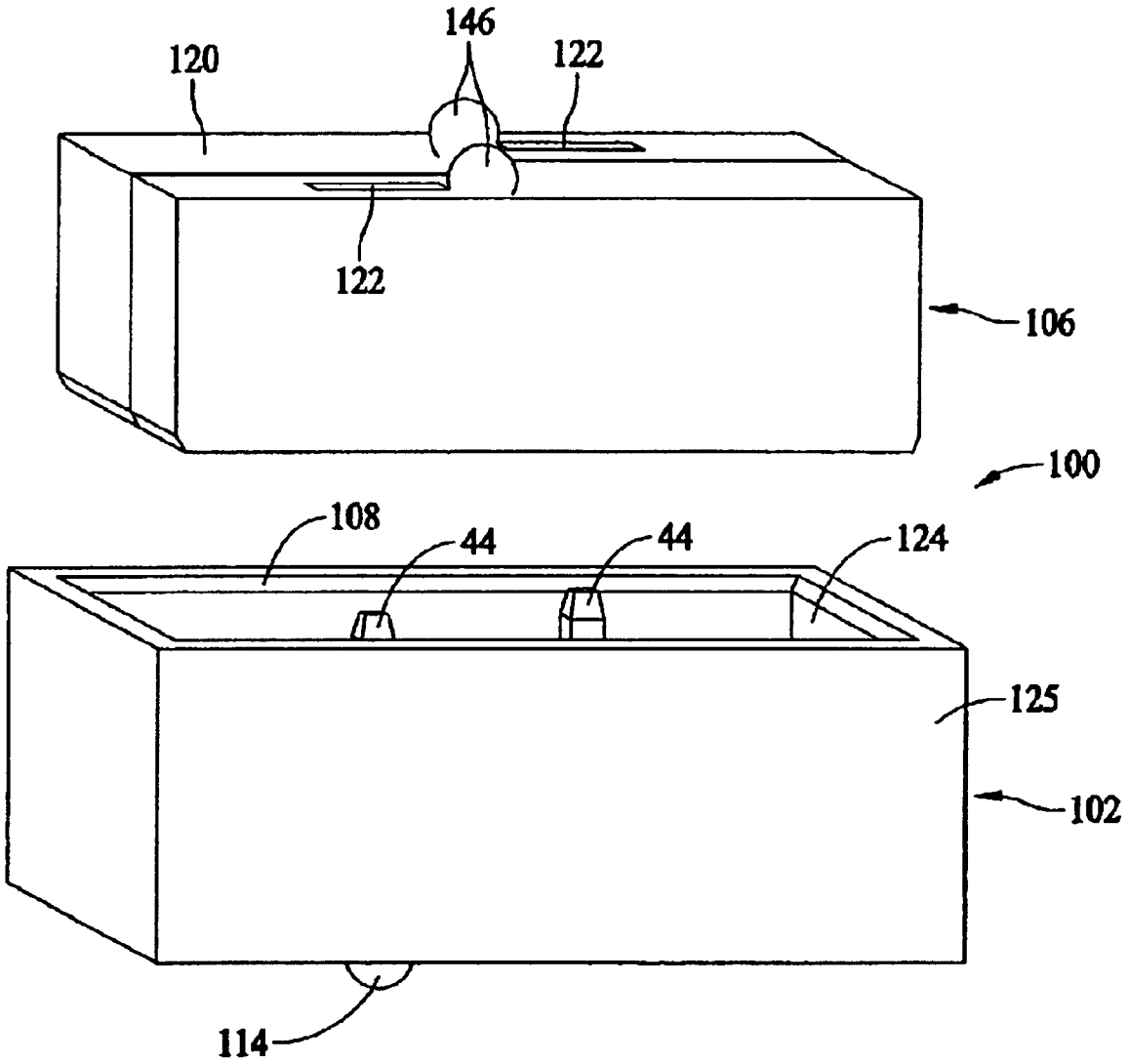
FIG. 5 is a bottom assembly view of a mating connector for the contact assembly shown in FIG. 4.

FIG. 5 is a bottom assembly view of the mezzanine connector 100 illustrating a bottom surface 120 having elongated engagement slots 122 which receive the retainer slots 88 (shown in FIG. 2) of the contacts 42 (shown in FIG. 4) within the housing 106. The solder balls 146 are located in cutout portions of the housing 106 adjacent the slots and are in communication with the projections 94 (shown in FIG. 3) of the respective contacts 42.

The male connector 102 includes a rectangular housing 108 and male pin contacts 44 extending within a contact cavity 124 formed into a housing 125. The male pin contacts 44 are engagable to the contact beams 54 and 56 (shown in FIGS. 3 and 4) via the guide members 68 (shown in FIGS. 3 and 4) of the contacts 42 within the contact assembly housing 106. Solder balls 114 are in communication with each of the male pin contacts 44 for electrical connection to a circuit board.

Figure 6:
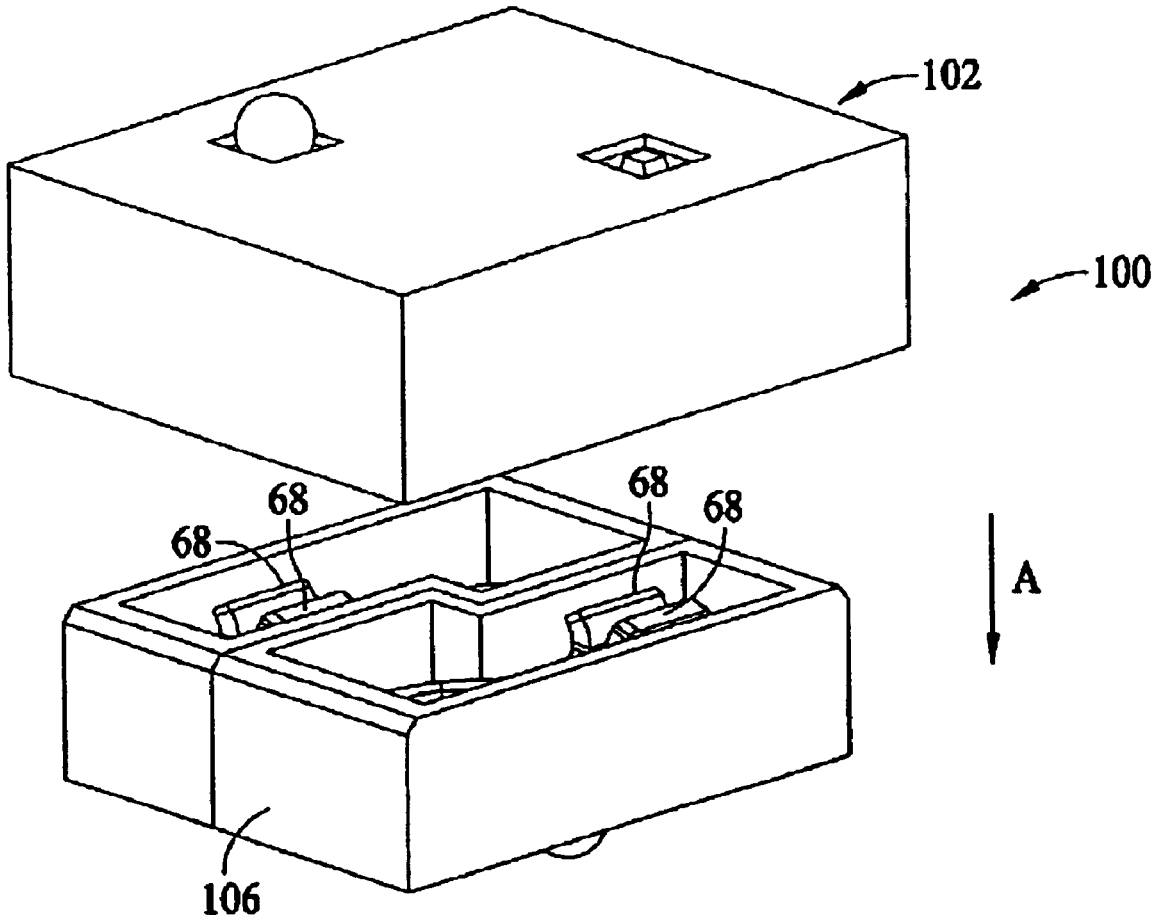
FIG. 6 is a top assembly view of the contact assembly shown in FIG. 4 with the mating connector shown in FIG. 5.

FIG. 6 is a top assembly view of the connector assembly 100 illustrating the male connector 102 and the contact assembly housing 106 in position to be mated. The male connector 102 is positioned over the contact assembly housing 106 such that the male pin contacts 44 in the male connector 102 are received and aligned by the guide members 68 of the female contacts 42 within the contact assembly housing 106 when the male connector 102 and the contact assembly housing 106 are engaged along a direction of arrow A.

Having now described the connector assemblies 10 and 100, it is appreciated that male and female connectors may be provided with any number of male contacts and female contacts desired. By nesting the female contacts as described above, more female contacts may be provided in a smaller space.

The above-described mezzanine connectors have a low profile satisfactory for compact devices in which known mezzanine connectors are incapable of use. The guide members in the female contact provide for self alignment of the male and female connectors and prevent damage from misaligned contacts.

While the invention has been described in terms of various specific embodiments, those skilled in the art will recognize that the invention can be practiced with modification within the spirit and scope of the claims.

What is claimed is:

1. A low profile contact comprising:

a rounded spring portion having a first end and a second end; and a first contact beam and a second contact beam extending from said respective first and second ends of said rounded spring portion, said rounded spring portion joining said first contact beam and said second beam, said first contact beam and said second contact beam having respective distal end portions that extend substantially parallel to each other along a longitudinal axis, said distal end portions are adapted to receive a pin therebetween, and at least one of said distal end portions has an upstanding guide surface that is configured to align the pin between said distal end portions as the pin is inserted along an insertion axis perpendicular to the longitudinal axis.

2. The low profile contact in accordance with claim 1, wherein each of said distal end portions has a respective said guide surface, and said guide surfaces are divergently flared relative to one another.

3. The low profile contact in accordance with claim 1, wherein said spring portion is arched between said first and second ends.

4. The low profile contact in accordance with claim 1, wherein at least one of said first and second contact beams is adapted to communicate with a solder ball.

5. The low profile contact in accordance with claim 1, wherein each of said contact beams has a lower edge and an upper edge, said guide surface extends from said upper edge of its respective said contact beam and has a flared tip.

6. The low profile contact in accordance with claim 5, wherein said contact has a profile dimension measured along said insertion axis, said profile dimension being less than about 2 mm between said tip and said lower edge.

7. A low profile contact assembly comprising:

a first contact comprising a curved resilient spring portion having a first end and a second end, and a first contact beam and a second contact beam extending from said respective first and second ends of said spring portion;

a second contact comprising a curved resilient spring portion having a first end and a second end, and a first contact beam and a second contact beam extending from said respective first and second ends of said spring portion; and said first and second contacts arranged inversely to one another such that said spring portions of each of said first and second contacts are oriented toward one another in a nested configuration.

8. The low profile contact assembly in accordance with claim 5 wherein at least one of said first and second contacts includes the first contact beam and the second contact beam having substantially parallel distal end portions, at least one of said distal end portions comprising an upstanding guide surface configured to receive and align a connection pin between said distal end portions.

9. The low profile contact assembly in accordance with claim 7, wherein each of said first and second contact beams of said first and second contacts comprises a guide surface, and said guide surfaces of adjacent contact beams are divergently flared relative to one another.

10. The low profile contact assembly in accordance with claim 7, wherein said first and second contact beams of said first and second contacts include distal end portions adapted to receive a pin therebetween as the pin is inserted along an insertion axis perpendicular to a longitudinal axis of said distal end portions.

11. The low profile contact assembly in accordance with claim 7, wherein said first and second contacts include at least one projection configured to contact a solder ball.

12. The low profile contact assembly in accordance with claim 7 wherein each of said contact beams extends along a longitudinal axis, said contact beams having a lower edge and an upper edge, and a guide surface extending from said upper edge and having a flared tip.

13. The low profile contact assembly in accordance with claim 12, said first and second contacts having a profile dimension measured along an insertion axis extending substantially perpendicular to said longitudinal axis, said profile dimension being less than about 2 mm between said flared tip and said lower edge.

14. A low profile electrical connector comprising:

a housing; and a first contact situated within said housing, said first contact comprising:

a curved resilient spring portion, and a first contact beam and a second contact beam extending from opposite ends of said spring portion, said first contact beam and said second contact beam having respective distal end portions extending along a longitudinal axis, at least one of said distal end portions comprising an upstanding guide surface configured to receive and align a connection pin inserted between said fist and second contact beams along an insertion axis extending substantially perpendicular to said longitudinal axis.

15. The low profile electrical connector in accordance with claim 14, wherein said housing is configured to maintain said first contact beam in a stationary position relative to said housing while permitting said second contact beam to deflect when said connection pin is inserted between said contact beams along said insertion axis.

16. The low profile electrical connector in accordance with claim 14 further comprising a second contact having a curved spring portion and first and second contact beams extending therefrom, said first and second contacts arranged in said housing in an inverse position relative to one another such that said spring portions of each of said first and second contacts are oriented toward one another in a nested configuration.

17. The low profile electrical connector in accordance with claim 14, wherein each of said first and second contact beams comprises a guide surface, and said guide surfaces of said first and second contact beams are divergently flared relative to one another.

18. The low profile electrical connector in accordance with claim 16, wherein said first and second contacts include at least one projection configured to contact a solder ball.

19. The low profile electrical connector in accordance with claim 14, wherein each of said first and second contact beams has a lower edge and an upper edge, said guide surface extends from said upper edge of its respective said contact beam and has a flared tip, said first contact has a profile dimension measured along said insertion axis, said profile dimension being less than about 2 mm between said flared tip and said lower edge.

* * * * *